United States Patent [19]

Wooley

[11] 4,194,546

[45] Mar. 25, 1980

[54] GARMENT NAIL ALIGNMENT BLOCK

[76] Inventor: Donald W. Wooley, 1017-B Cascade St., Mesquite, Tex. 75149

[21] Appl. No.: 888,160

[22] Filed: Mar. 20, 1978

[51] Int. Cl.[2] ..... B25C 3/00

[52] U.S. Cl. ..... 145/46

[58] Field of Search ..... 145/46, 50 F

[56] References Cited

U.S. PATENT DOCUMENTS

| | | | |
|---|---|---|---|
| 620,426 | 2/1899 | Danzer . | |
| 1,575,582 | 3/1926 | Joy | 145/46 |
| 2,635,237 | 4/1953 | Langer | 145/46 |
| 2,757,457 | 1/1955 | Ziegelski . | |
| 3,147,484 | 9/1964 | Nelson . | |
| 3,328,890 | 7/1967 | Fagerberg . | |
| 3,381,551 | 5/1968 | Lavering . | |
| 3,885,314 | 5/1975 | Banas . | |
| 4,037,632 | 7/1977 | Arena | 145/46 |
| 4,079,765 | 3/1978 | Hatayan | 145/46 |

FOREIGN PATENT DOCUMENTS

| | | | |
|---|---|---|---|
| 566451 | 4/1958 | Belgium | 145/46 |
| 1088438 | 9/1960 | Fed. Rep. of Germany | 145/46 |
| 1159868 | 12/1963 | Fed. Rep. of Germany | 145/46 |
| 846337 | 8/1960 | United Kingdom | 145/50 F |

*Primary Examiner*—James G. Smith
*Assistant Examiner*—J. T. Zatarga
*Attorney, Agent, or Firm*—Richards, Harris & Medlock

[57] ABSTRACT

A transparent block includes at least one garment nail alignment hole formed completely through the block and normal to a surface of the block. The alignment hole is dimensioned to closely receive a garment nail which is to be set normal to the surface of a garment cutting table. The alignment hole prevents bending of the garment nail when it is set normal to the garment cutting table. In an alternate embodiment, a second alignment hole is formed through the lengthwise dimension of the rectangular block for using the block in another orientation to align a longer garment nail.

9 Claims, 7 Drawing Figures

GARMENT NAIL ALIGNMENT BLOCK

FIELD OF THE INVENTION

This invention relates to alignment blocks, and more particularly relates to a transparent alignment block having an alignment hole formed through the block and normal to one surface of the block for aligning garment nails normal to the surface of a garment cutting table.

DESCRIPTION OF THE PRIOR ART

In the garment industry, garment manufacturers use garment nails or spikes to secure layers of material to a garment cutting table. The garment cutting table is usually a long table with a wooden top and rails running along both sides for carrying a garment spreading machine. The machine spreads layers of material upon the table for the cutting operation.

The garment nails are used to secure striped or plaid material to the cutting table, so that when the material is cut the stripes or plaids may be properly aligned when the garment is sewn together. The garment nail is pointed on both ends, such that one end is driven into the wooden surface of the table and the other end pierces the layers of material placed on top of the nail. The garment nail has an identation formed near the top for receiving the bearing and locking ring of a garment nail holder. The garment nail is driven into the wooden table to the required depth by striking the top of the garment nail holder.

Presently, the alignment of the nail normal to the garment table is made after the nail is driven into the table. An L-shaped alignment guide is frequently used to align the garment nail normal to the table. The garment nail is brought into alignment after it is driven into the table by repeatedly hammering the nail laterally until it appears to be normal to the table. The height of the nails must also be checked to set all the nails at a uniform height above the table to accommodate the thickness of the layers of material.

The present practice of aligning garment nails is unsatisfactory because of the difficulty in setting the nail normal to the table and time that is consumed in attempting to align the garment nail normal to the surface of the garment cutting table. In addition, the practice of striking the garment nail laterally with a hammer often bends the nail so much that it cannot be used again. Even a slight bend in the garment nail will render the nail useless the next time the garment nail is driven into the garment cutting table.

A need has thus arisen for a garment nail alignment device which can be used to quickly align a garment nail normal to a garment cutting table without bending the nail. In addition, a need has arisen for a garment nail alignment device which allows a garment nail to be set a predetermined uniform height above the surface of the garment cutting table.

SUMMARY OF THE INVENTION

The present invention provides a garment nail alignment block to reduce the time it takes to align a garment nail normal to a cutting table, while preventing the garment nail from being bent out of alignment. The alignment block also provides a means for setting the garment nails a predetermined uniform distance above the table.

In accordance with the present invention, a transparent block includes at least one alignment hole formed completely through the block and normal to one surface of the block. The nail alignment hole is dimensioned to closely receive a garment nail which can be set on the exact spot marked on the pattern sheet by viewing the mark through the transparent upper surface of the block. The height of the nail alignment hole is determined by a predetermined relationship to the height of a standard garment nail.

Also, in accordance with the present invention, the garment nail alignment block includes a second set of alignment holes formed completely through the block and normal to the first set of alignment holes. The second set of alignment holes is dimensioned to closely receive a garment nail to prevent its bending when driven into the table.

Further in accordance with the present invention, a garment nail depth marker is provided in the alignment block for determining the exact distance the garment nail is to be set into the surface of the garment cutting table. The garment nail depth marker may comprise a well fitted with a cylindrical sleeve to prevent tipping of a marking material from the well when the block is in either of the two garment nail setting positions for the alternate embodiment of the alignment block.

BRIEF DESCRIPTION OF THE DRAWINGS

For a more complete understanding of the present invention and further advantages thereof, reference is now made to the following description taken in conjunction with the following drawings.

DESCRIPTION OF THE PREFERRED EMBODIMENT

Figure 1:
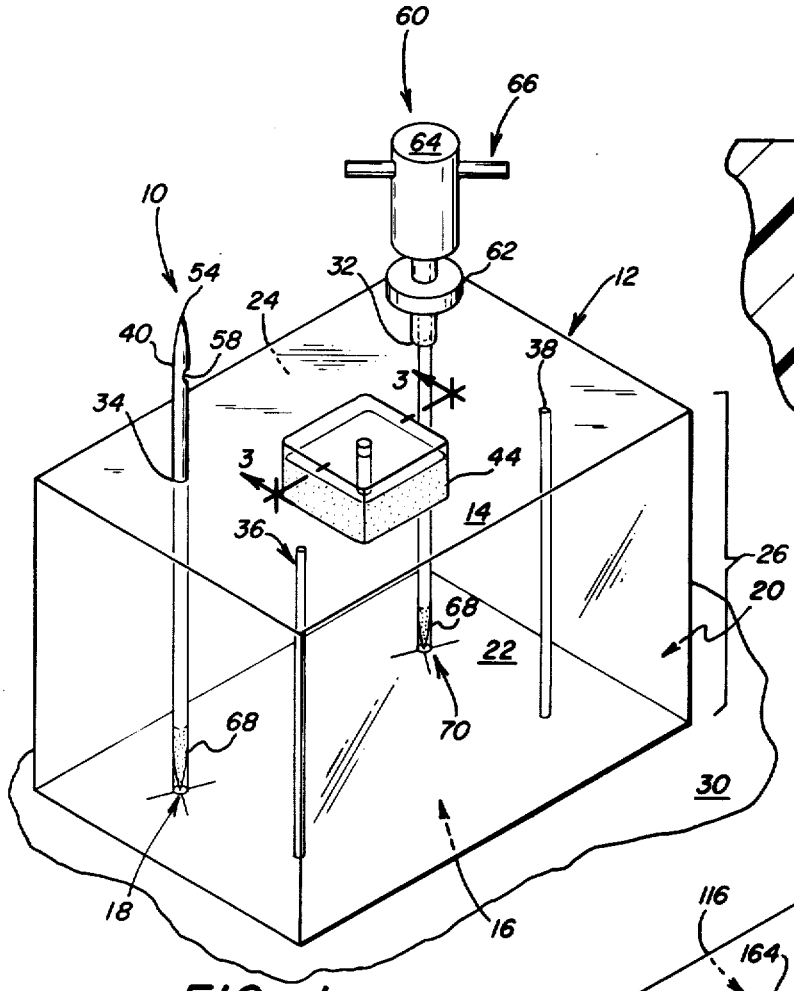
FIG. 1 is a perspective view of the preferred embodiment of the present invention.
Figure 3:
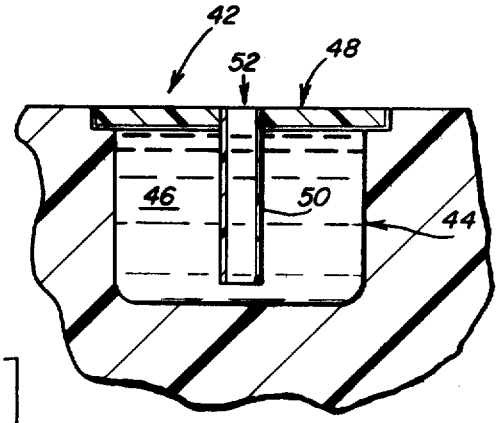
FIG. 3 is a broken away side view taken along the line 3—3 in FIG. 1.
Figure 2:
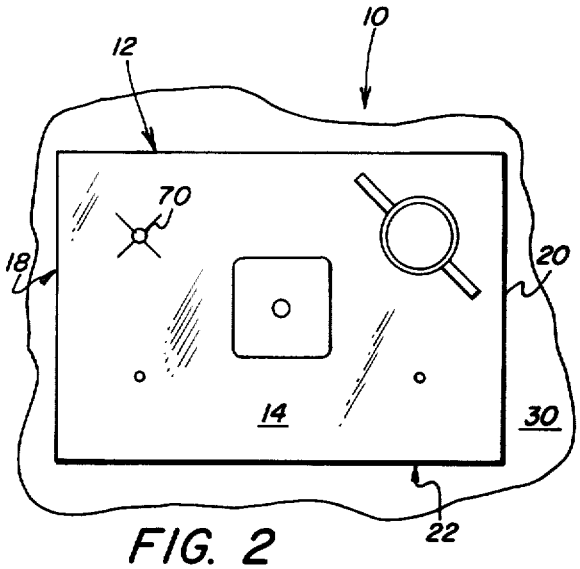
FIG. 2 is a plan view of the preferred embodiment of the present invention.

FIGS. 1 and 2 illustrate the preferred embodiment of a garment alignment device of the present invention, generally identified by the reference numeral 10. The garment alignment device 10 of the present invention is a transparent rectangular alignment block 12, including an upper surface 14, a lower surface 16, end surfaces 18 and 20, and front and back surfaces 22 and 24. The alignment block 12 is illustrated with the lower surface 16 resting on the surface of a garment pattern sheet 30 of the garment cutting table.

The garment nail alignment block 12 includes garment nail alignment holes 32, 34, 36 and 38 formed completely through the block 12. The nail alignment holes 32, 34, 36 and 38 are right circular cylindrical openings normal to the lower surface 16 resting on the pattern sheet 30. The nail alignment holes 32 and 34 have the same diameter for receiving a garment nail 40, while the nail alignment holes 36 and 38 are of a reduced diameter to accommodate smaller diameter nails 40. The height 26 of the alignment block 12 between the surfaces 14 and 16 provides alignment holes 32, 34, 36 and 38 of sufficient length to support the nail 40. Of course, the selection of the number, location and size of the alignment holes may vary.

The upper surface 14 of the alignment block 12 includes a nail depth marker 42. The depth marker 42 includes a rectangular well 44 formed in the upper surface 14 and containing a quantity of marking material 46, such as an indelible black ink or a powdered material. The well 44 is sealed by a locking cap 48 having a cylindrical tube 50 inserted into a central opening 52. The cylindrical tube 50 extends into the material 46 a short predetermined distance above the bottom wall of the well 44, so that the material 46 is retained within the depth marker 42 when the alignment block 12 is placed in an orientation different from that shown in FIGS. 1 and 2.

The garment nails 40 are shown placed within nail alignment holes 32 and 34. The garment nail 40 includes a pointed upper end 54 and a pointed lower end 56. The notch 58 is formed in the upper portion of the garment nail 40 for engaging a garment nail holder 60. The garment nail holder 60 is shown in FIG. 1 secured to the garment nail 40 positioned within the nail alignment hole 32. The garment nail holder 60 includes a bearing and sleeve locking device 62 for engaging the notch 58 of the garment nail 40. The bearing and sleeve locking assembly 62 is secured to the nail 40 when setting and removing it from the garment cutting table. The garment nail holder 60 includes an upper surface 64 for transmitting a force from a hammer to the garment nail 40 to set it into the garment cutting table without dulling the pointed upper surface 54. A cross bar 66 is provided for gripping the garment nail holder 60 to provide an upward force to extract a garment nail 40 from the garment cutting table.

A depth marking 68 is illustrated on the garment nail 40 positioned within the nail setting holes 32 and 34. The depth marking 68 is provided by inserting the nail 40 into the depth marker 42 to determine the depth the nail 40 is to be set into the garment cutting table. The transparency of the alignment block 12 allows the individual setting the garment nail 40 to look through the upper surface 14 and see a mark 70 placed on the cutting pattern piece 30, which determines where the nail 40 is to be set. The transparency of the alignment block 12 also allows the nail setter to determine the depth the nail 40 is to be set into the table by observing the depth marking 68 on the bottom portion of the nail 40 as it is set into the cutting table.

Figure 4:
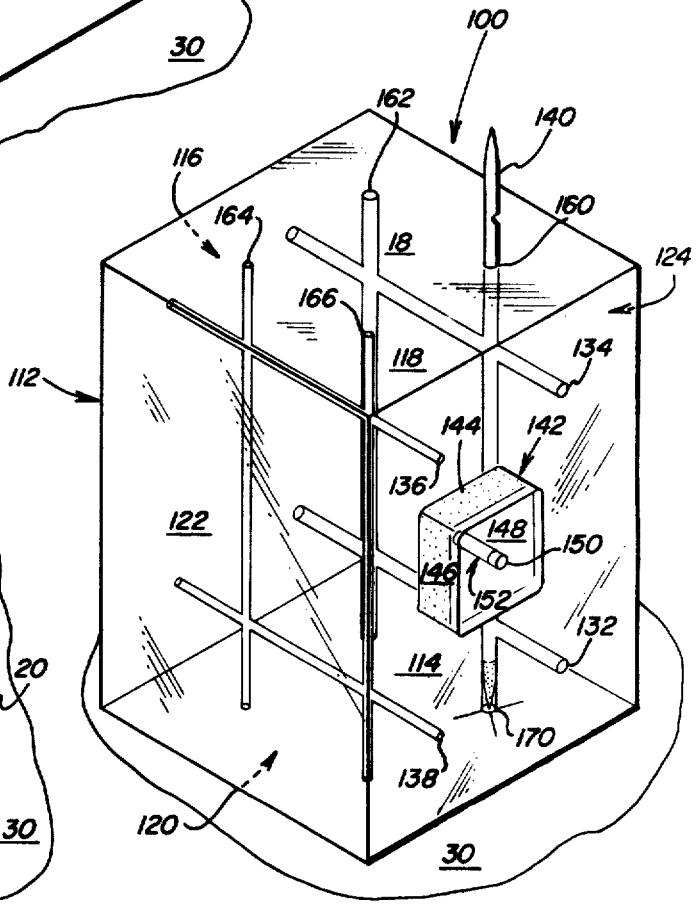
FIG. 4 is an alternate embodiment of the present invention.

FIG. 4 illustrates an alternate embodiment of a garment nail alignment device, generally identified by the reference numeral 100. The alternate embodiment of the garment nail alignment device 100 includes several elements similar to the elements of the garment nail alignment device 10. Those elements of the garment nail alignment device 100 which correspond with similar elements of the alignment device 10 are identified by the same reference numerals increased by 100.

A transparent rectangular block 112 includes surfaces 114, 116, 118, 120, 122, and 124. A first set of nail alignment holes 132, 134, 136 and 138 extends completely through and normal to the surfaces 114 and 116. The first set of nail alignment holes 132, 134, 136, and 138 may be used to align a garment nail 40 when the alignment block 112 is oriented with the surface 116 resting on a garment cutting pattern piece 30, similar to the orientation of the alignment block 12 in FIG. 1.

The alignment block 112 also includes a depth marker 142 formed in a recess 144 in the surface 114. A depth marking material 146 is retained in the recess 144 by a retaining cap 148, which includes a cylindrical tube 150 inserted through a central opening 152 of the cap 148.

A second set of nail alignment holes 160, 162, 164, and 166 is formed completely through the block 112 and normal to the surfaces 118 and 120. The first and second sets of alignment holes are formed as right circular cylindrical openings to closely receive the cylindrical shaft of the nails 40 and 140. When the block 112 is oriented as in FIG. 4 with the surface 120 resting on a garment cutting piece 30, the second set of alignment holes 160, 162, 164 and 166 may be used to align garment nails 140, which are too long to be supported by the first set of garment nail alignment holes 132, 134, 136, and 138 to prevent bending of the nail 140. A garment nail 140 is illustrated in the alignment hole 160 and positioned over the garment nail mark 170 on the cutting pattern 30. The garment nail 140 may be driven into the garment cutting table by the garment nail holder 160 in the same manner as illustrated in FIGS. 1 and 2.

Figure 5:
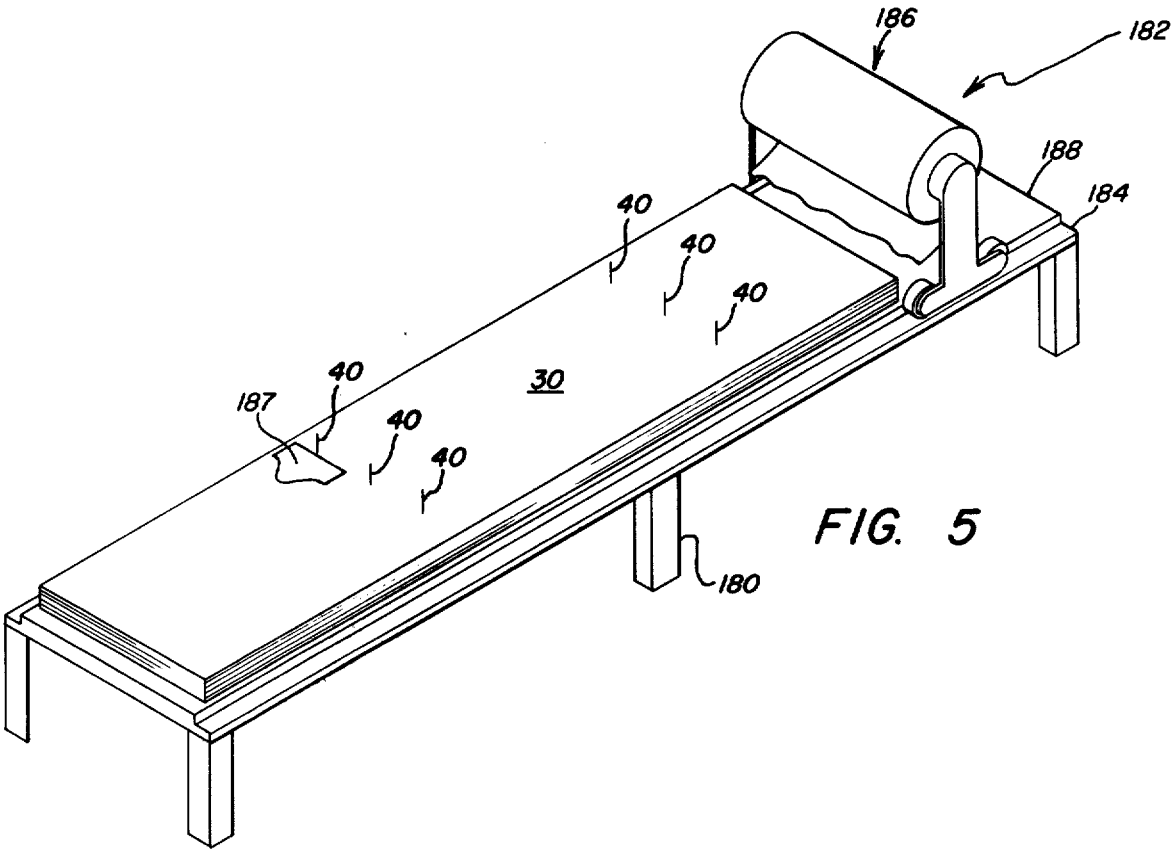
FIG. 5 is a perspective view of the present invention utilized on a garment cutting table.
Figure 6:
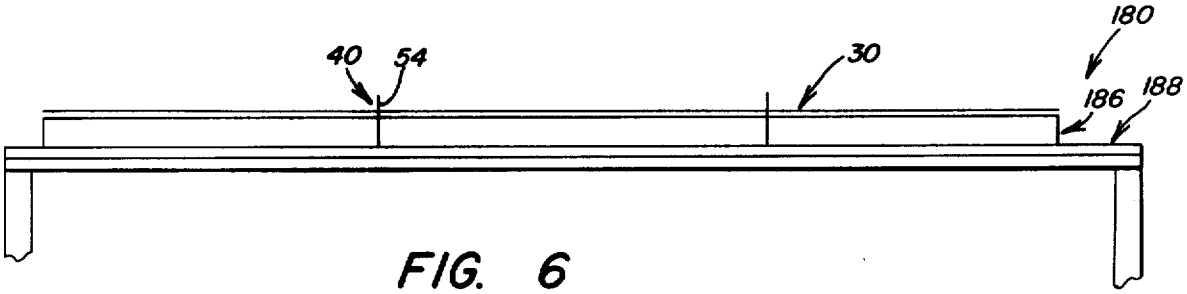
FIG. 6 is a side view of the garment cutting table of FIG. 5.
Figure 7:
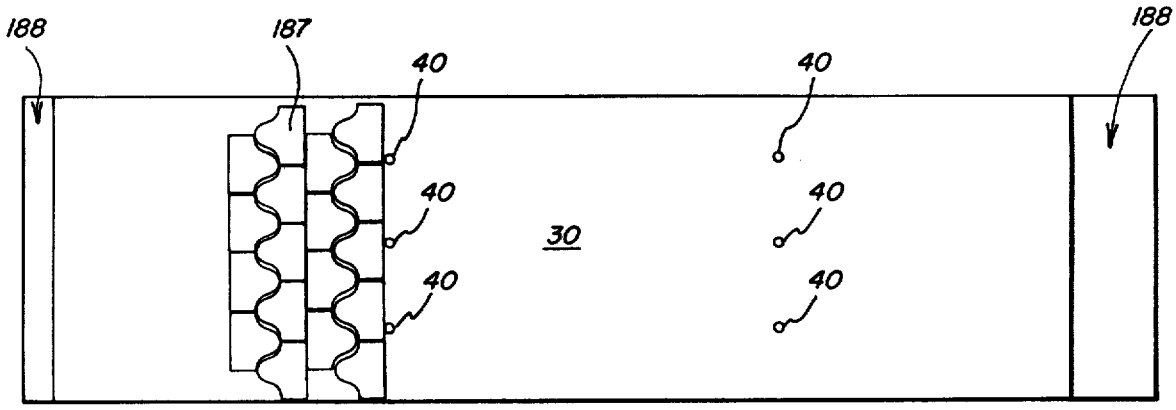
FIG. 7 is a plan view of the garment cutting table of FIG. 5.

FIGS. 5, 6 and 7 illustrate the use of garment nails 40 set with the garment nail alignment device 10 of the present invention in the garment cutting operation. A typical garment cutting table 180 is illustrated with a garment spreading machine 182 supported for movement upon the tracks 184 of the table 180. A roll of material 186 is supported upon the garment spreader 182 for spreading the desired number of layers of material 186 on an upper surface 188 of the table 180. A first layer of material 186 is spread upon the upper surface 188 as the spreading device 182 is moved across the tracks 184. Material 186 is cut and the garment spreading machine 182 is brought back into position for spreading a second layer of material 186.

The garment nails 40 are set into the upper surface 188 of the garment table 180 before the first sheet of material is spread upon the table 180. The placement of the garment nails 40 is arranged according to marks on the garment pattern cutting piece 30. As each layer of material 186 is spread across the table 180, the plaids or stripes on the material 186 are properly aligned by securing the material in place by piercing it with the pointed upper surface 54 of the garment nail 40. The garment pattern cutting piece 30 is removed from the table after the garment nails 40 have been set for layering the material 186 on top of the table 180. Upon completion of the layering operation, the garment pattern cutting piece 30 is stapled to the top of the layer of material 186 for marking the patterns for the cutting operation. A typical pattern 187 is illustrated on the surface of the pattern sheet 30 to be cut from the layers of material 186.

In setting the nails 40, the garment nail alignment block 12 is positioned on top of the garment pattern cutting piece 30 spread along the upper surface 188 of the garment cutting table 180. The garment pattern cutting piece 30 contains a number of marks 70 where a garment nail 40 is to be set into the table 180. The location of the garment nails 40 is determined by the garment cutter so that the plaid or striped pattern on the material 186 will match after the garment is cut and sewn together.

The alignment block 12 is placed on the garment cutting sheet 30 with the lower surface 16 resting on the table 180. One of the alignment holes 32, 34, 36, and 38 is chosen that corresponds to the diameter of the garment nail 40. The selected alignment hole 32, 34, 36, or 38 is positioned directly over the mark 70. The garment nail 40 is inserted in the depth marker 42 in order that all of the nails 40 are set at a uniform depth into the table 180. The upper end 54 of the garment nail 40 is then secured by the garment nail holder 60, where the locking bearing and sleeve assembly 62 engages the notch 58. The garment nail 40 is inserted in the nail alignment hole 32 positioned over the mark 70, as illustrated in FIG. 1. The garment nail 40 is driven into the table by striking the upper surface 64 of the garment nail holder 60 with a hammer. The garment nail holder 60 is then removed from the nail 40 by releasing the bearing and sleeve assembly 62. The garment nail alignment block 12 is then removed by lifting the block directly over the top of the garment nail 40. The alignment block 12 is then moved to the next mark 70 on the cutting pattern 30 for inserting the next garment nail 40.

When a longer garment nail 140 is to be set into the table 180, the cutting operator may select a different alignment block 12 having a greater height 26 for the alignment holes 32, 34, 36, and 38 so that the garment nail 40 is received within the first set of alignment holes 32, 34, 36 and 38 to prevent bending when being driven into the table. Alternatively, the operator may use a garment alignment block 112 as illustrated in FIG. 4 and described hereinabove. The alignment block 112 includes a second set of alignment holes 160, 162, 164, and 166 for accommodating garment nails 140 which are too long for the alignment holes of the alignment block 12. A longer alignment hole reduces the risk of bending the nail 40 or 140. Thus, the alternate embodiment of the alignment device 112 may be utilized in aligning either garment nails 40 or longer garment nails 140.

It will be understood that the alignment devices 10 and 100 may be constructed of any suitable transparent material, but they are preferably made from a clear plastic material such as Lucite. It will be further understood that any desired number, size or shape of the first set of alignment holes or the second set of alignment holes can be formed through the alignment blocks 12 or 112. It will be further understood that the dimensions and shape of the garment nail alignment devices 10 and 100 can be altered, and the invention is not limited to the rectangular parallelpiped illustrated in the accompanying drawings. For example, the alignment device 10 could be configured as a cylindroid or truncated cone or pyramid. The alignment device 10 is only required to have one planar surface with an alignment hole formed normal to that surface, and the block can be of any desired geometric configuration.

Although preferred embodiments of the invention have been illustrated in the accompanying drawings and described in the foregoing detailed description, it will be understood that the invention is not limited to the embodiments disclosed, but they are capable of numerous rearrangements, modifications and substitution of arts and elements without departing from the spirit of the invention.

What is claimed is:

1. A garment nail alignment device for aligning garment nails normal to a garment cutting table, comprising:

a transparent block having at least one planar surface;

means for marking a garment nail to indicate the length of the garment nail to be set into the garment cutting table; and at least one right circular cylindrical garment nail alignment hole dimensioned to closely engage the garment nail and formed completely through and normal to said planar surface of said block, such that a spot on the garment cutting table where a garment nail is to be set normal to the table is visible through said transparent block for aligning said hole over the spot and the garment nail marked by said marking means is visible through said block for determining the depth the nail is set into the garment cutting table.

2. The garment nail alignment device of claim 1, wherein said transparent block includes a second right circular cylindrical garment nail alignment hole, said holes having different diameters such that said block can be used to align different diameter garment nails.

3. The garment nail alignment device of claim 1, wherein said transparent block is a rectangular parallelepiped.

4. The garment nail alignment device of claim 1, wherein said transparent block is a cylindroid.

5. The garment nail alignment device of claim 1, wherein said transparent block is a truncated prism.

6. A garment nail alignment device for aligning garment nails normal to a garment cutting table, comprising:

a transparent rectangular parallelepiped block;

a first set of right circular cylindrical garment nail alignment holes formed completely through and normal to first and second surfaces of said block, said first set of holes having a diameter dimensioned to closely support the garment nail; and a second set of right circular cylindrical alignment holes formed completely through and normal to third and fourth surfaces of said block, said second set of holes having a diameter dimensioned to closely support the garment nail, such that said first and second sets of garment nail alignment holes have different lengths to align garment nails of different lengths normal to the garment cutting table without bending the garment nails.

7. The garment nail alignment device of claim 6 and further comprising:

means for marking the length of a garment nail to be set into the garment cutting table, such that all garment nails may be marked at a uniform predetermined depth when set into the garment cutting table.

8. A garment nail alignment device for aligning garment nails normal to a garment cutting table, comprising:

a transparent block having at least one planar surface;

at least one right circular cylindrical garment nail alignment hole formed through said block normal to said planar surface;

a recessed portion formed in a surface of said block, said recessed portion having a depth corresponding to the depth a garment nail is to be set into the garment cutting table;

material for marking the garment nails contained within said recessed portion; and a cap having a central opening for admitting the garment nail and for sealing said material in said recessed portion, such that a garment nail may be inserted into said marking material to mark the depth the garment nail is to be set into the garment cutting table.

9. A garment nail device for aligning garment nails at a predetermined depth normal to a garment cutting table, comprising:

a transparent rectangular parallelepiped block;

a first set of right circular cylindrical garment nail alignment holes formed completely through and normal to first and second surfaces of said block;

a second set of right circular cylindrical garment nail alignment holes formed completely through and normal to third and fourth surfaces of said block, such that first and second sets of garment nail alignment holes have different lengths to align garment nails of different lengths normal to the garment cutting table without bending the garment nails;

a recessed well of a predetermined depth formed in one surface of said block;

a garment nail marking material contained within said recessed well; and a cap sealing said nail marking material within said recessed well, said cap having a central opening for marking the depth the nail is to be set into the garment table.

* * * * *